United States Patent [19]

Mirshak

[11] 3,946,699

[45] Mar. 30, 1976

[54] AUTOMATIC FLAG STORAGE AND DISPLAY DEVICE

[75] Inventor: Richard C. Mirshak, Succasunna, N.J.

[73] Assignee: Lawrence Peska Associates, Inc., New York, N.Y. ; a part interest

[22] Filed: Dec. 6, 1974

[21] Appl. No.: 530,291

[52] U.S. Cl. ..... 116/174; 116/173

[51] Int. Cl.[2] ..... G09F 17/00

[58] Field of Search ..... 116/173, 174, 114 R; 40/218, 129 A

[56] References Cited

UNITED STATES PATENTS

| | | | |
|---|---|---|---|
| 1,288,060 | 12/1918 | Le Duc | 116/173 |
| 1,339,849 | 5/1920 | Johnson | 116/174 |
| 3,797,450 | 3/1974 | Frisbee | 116/173 |

*Primary Examiner*—S. Clement Swisher
*Assistant Examiner*—Denis E. Corr

[57] ABSTRACT

An automatic flag storage and display device which has a hollow tubular member and a first pole member supported within the tubular member. The axis of the tubular member and the axis of the first pole member are parallel. The first pole member is adapted for extension and retraction from the tubular member. The device further has a second pole member pivotally mounted to the outward end of the first pole member. There is a release means for automatically extending the second pole member so as to unfurl a flag attached to the first and second pole members, when the first pole member is extended from the hollow tubular member. The device further has a pole extension means for automatically extending the first pole member.

10 Claims, 5 Drawing Figures

AUTOMATIC FLAG STORAGE AND DISPLAY DEVICE

This invention relates generally to flag display devices and more particularly concerns a novel mechanism for automatically extending a flag for display and for retracting it to a protected position.

Several attempts have been made to devise a practical apparatus to transport a flag from a furled or stored position to a position of display. Most of these devices are basically stationary devices, that is devices which are not to be used during parades, marches, etc. These devices have generally been described as hollow flag poles or a hollow portion thereof into which or from which a flag is dragged by means of an appropriately rigged halyard, either for protection of the elements or as an alternative to the customary lowering or raising of the flag at evening or morning. Some other devices provide a separate enclosure thru which the halyard runs so that the flag may be brought within the enclosure for storage and protection. Still other devices have been provided a slot in the side of a flagpole and an internal shaft upon which the flag may be rolled; by rotating the shaft the flag is drawn in thru the slot and is protected.

Many of the prior art devices have not been practical in that they tend to bind, or by subjecting the flag to frequent frictional contact with an aperture, tend to appreiably shorten its useful life. Others are cumbersome, expensive or otherwise impractical for the home owner who may wish to display his flag but finds it an inconvenience to go outdoors or open a window to put the flag out and take it in. Inconveniences proportionally greater in flag display on large buildings or in public insitutions. This inconvenience is very great when it is attempted to have an automatic flag storage and display device for use in parades, marches, etc.

Broadly speaking the invention discloses an automatic flag storage and display device for furling a flag and unfurling a flag by extending or retracting a shaft into a protective tube and alternatively extending this shaft from the protective tube and unfurling the flag. Several embodiments are disclosed. The mechanism generally comprises a hollow tubular member, a first pole member coaxially supported within the tubular member and adapted for extension and retraction there from and there into, an automatic flag unfurling means attached to the first pole member for unfurling the flag attached to the first pole member when the first pole member is extended from the hollow tubular member, and a pole extension means for automatically extending the first pole member.

This device may be attached to the wall of a building, the floor in a building, the ground outside a building and is particularly designed to be of a portable nature so as to be used in a parade, march, etc.

Appropriate controls and switches may be provided on the device for operating the device.

It is readily apparent that this device enables one to easily display the flag whenever he wishes without inconvenience and, in particular for displaying a flag automatically while marching, parading, etc.

Figure 1:
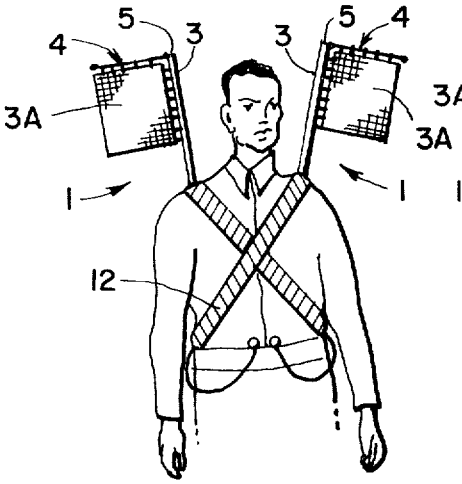
FIG. 1 is a front view of a person carrying a pair of the automatic flag storage and display devices on his back.
Figure 2:
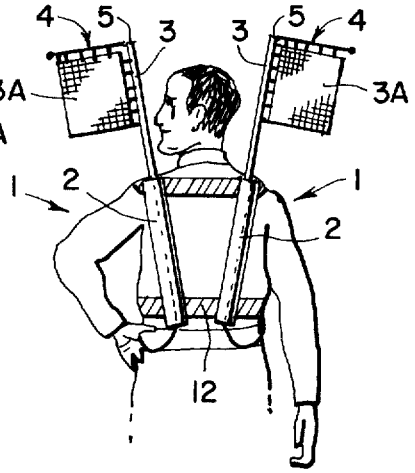
FIG. 2 is a rear view of a person carrying a pair of the automatic flag storage and display devices on his back.
Figure 3:
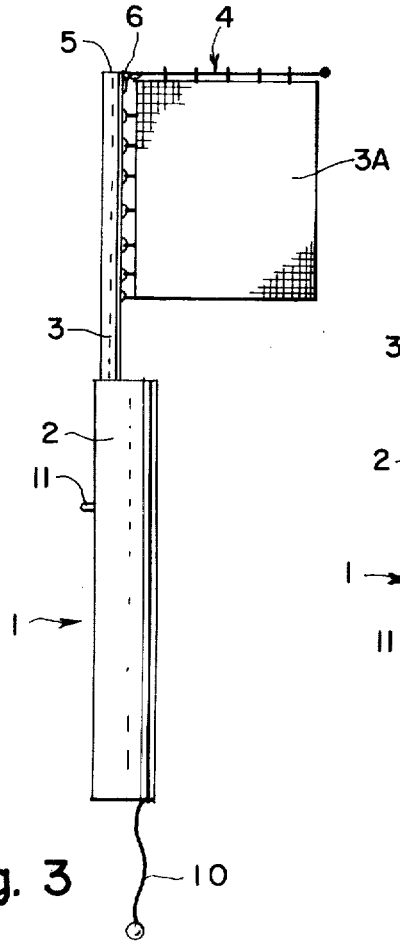
FIG. 3 is a view of the automatic flag storage and display device showing an extended flag pole and flag unfurled.
Figure 4:
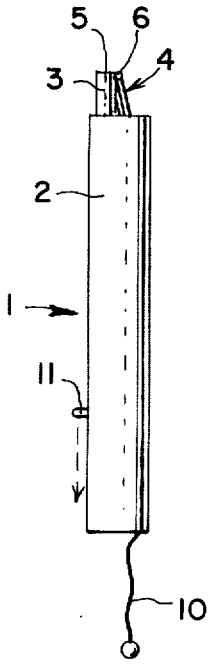
FIG. 4 is a view similar to FIG. 3 showing the flag pole retracted and the flag unfurled.
Figure 5:
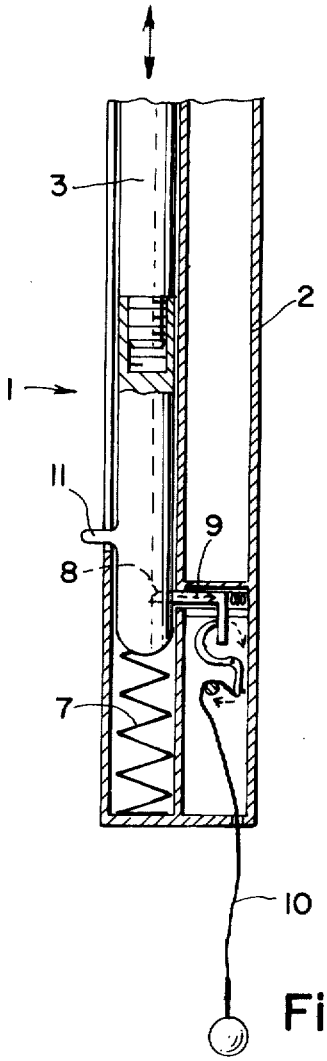
FIG. 5 is an enlarged detail sectional view of one example of the automatic flag storage and display device, showing the mechanism which provides for the automatic extension of the first pole member, i.e. the flag pole.

With reference now to FIGS. 1 through 5 of the drawings, there is shown an automatic flag storage and display device, generally 1.

The device is comprised of a hollow tubular member 2. The hollow tubular member may be circular, rectangular, etc., however it is preferred that it be a cylindrical tubular member.

A first pole member 3 is supported within the hollow tubular member 2 and adapted for extension and retraction there from and there into. The axis of the tubular member and the axis of the first pole member are parallel.

The automatic flag storage and display device is further comprised of an automatic unfurling means 4, for example, attached to the first pole member for unfurling a flag 3A attached to the first pole member when the first pole member 3 is extended from the hollow tubular member 2.

The automatic flag unfurling means 4 may be, for example, comprised of a second pole member, also referred to as 4, pivotally mounted to the outward end of the first pole member 5. A release means for automatically extending the second pole member so as to unfurl a flag attached to the first and second pole members when the first pole member is extended from the hollow tubular member. Such a release means, for example, may be a spring attached to and mounted between the first pole member 3 and the second pole member 4.

The automatic flag storage and display device is further comprised of a pole extension means for automatically extending the first pole member.

The pole extension means may be comprised of, for example, an ejection spring 7 mounted within the hollow tubular member 2 and below the first pole member 3. The pole extension means, for example, may further be comprised of a catch means 8 mounted on the first pole member 3 and a pole latch means attached to the hollow tubular member 9 for engaging the catch means 8 when the first pole member 3 is in a retracted position in the hollow tubular member 2 whereby the ejection spring 7 is maintained in a compressed position. The pole extension means, for example, may further be comprised of a pole release means for disengaging the pole latch means 9 from the catch means 8 thereby ejecting the first pole member 3 from the hollow tubular member 2.

The catch means, for example, may be a hole 8 in the first pole 3 and the pole latch means may be a movable bolt 9 which engages the hole 8.

The pole release means, for example, may be a lanyard 10 attached to the movable bolt 9 to disengage the bolt 9 from the hole 8.

The automatic flag storage and display device may further be comprised of a means for retracting the first pole member 11 whereby the pole latch means engages the catch means.

This device may further be comprised of a means for attachment of this automatic flag storage and display device to a person. The means for attachment may be, for example, a strap 12 attached to the outside of the hollow tubular member.

In use the automatic flag storage and display device may be mounted either stationary or in a mobile position. When stationary it may be mounted on the ground, on a building, etc. It is preferred however that this device be portable and used for parades, marches, etc., mounted on a person, animal, vehicle, etc.

A person desiring to use this device will retract the first pole member, closing, for example, the automatic flag unfurling means so that the flag and the first pole member are enclosed by the hollow tubular member. When the pole latch means and the catch means are engaged the pole member is in its retracted position and the flag is in its unfurled position within the hollow tubular member.

When a group of people, vehicles, etc. are parading or marching at a certain signal the flags may be automatically unfurled by, for example, reactivating the release means, i.e., a lanyard, to disengage the pole latch means from the catch means and cause the first pole member to extend and the flag unfurl.

The automatic flag storage and display device may be preferably mounted on the backs of persons, for use in marching. At a predetermined signal, i.e., from a conductor, the marching members can pull, for example, the lanyards and the flags will unfurl. When 100 or 200 members of the marching group unfurl the flag at one time, or in a systematic manner, this can be impressive to the persons observing this march.

While there have been described herein what are at present considered preferred embodiments of the invention, it will be obvious to those skilled in the art that many modifications and changes may be made therein without departing from the essence of the invention. It is therefore to be understood that the exemplary embodiments are illustrative and not restrictive of the invention, the scope of which is defined in the appended claim, and that all modifications that come within the meaning and range of equivalency of the claim are intended to be included therein.

Having herein described the invention, what is claimed as new is:

1. an automatic flag storage and display device comprising:

a. a hollow tubular member;

b. a first pole member supported within the tubular member so that the axis of the tubular member and the axis of the first pole member are parallel and said first pole member is adapted for extension and retraction therefrom and thereinto;

c. a second pole member pivotally mounted to the outward end of the first pole member;

d. a release means for automatically extending the second pole member so as to unfurl a flag attached to the first and second pole members when the first pole member is extended from the hollow tubular member;

e. a pole extension means for automatically extending the first pole member.

2. The automatic flag storage and display device of claim 1, wherein the release means is a spring attached to and between the first pole member and the second pole member.

3. The automatic flag storage and display device of claim 1, further comprised of a means for attachment of the automatic flag storage and display device to a person.

4. The automatic flag storage and display device of claim 3, wherein the means for attachment is a strap which is long enough to go around the body of a person, attached to the outside of the hollow tubular member.

5. An automatic flag storage and display device comprising:

a. a hollow tubular member;

b. a first pole member supported within the tubular member so that the axis of the tubular member and the axis of the first pole member are parallel and said first pole member is adapted for extension and retraction therefrom and thereinto;

c. an automatic flag unfurling means attached to the first pole member for unfurling a flag attached to the first pole member when the first pole member is extended from the hollow tubular member;

d. an ejection spring mounted within the hollow tubular member and below the first pole member;

e. a catch means mounted on the bottom of the first pole member;

f. a pole latch means attached to the hollow tubular member for engaging the catch means when the first pole member is in a retracted position in the hollow tubular member and the spring is thereby maintained in a compressed position; and g. a pole release means for disengaging the pole latch means from the catch means thereby ejecting the first pole member from the hollow tubular member.

6. The automatic flag storage and display device of claim 5, wherein the catch means is a hole in the bottom of the first pole member; and the pole latch means is a movable belt which engages the hole.

7. The automatic flag storage and display device of claim 6, wherein the pole release means is a lanyard attached to the movable belt to disengage the belt from the hole.

8. The automatic flag storage and display device of claim 5, further comprised of a means for retracting the first pole member whereby the pole latch engages the catch means.

9. The automatic flag storage and display device of claim 5, further comprised of a means for attachment of the automatic flag storage and display device to a person.

10. The automatic flag storage and display device of claim 9, wherein the means for attachment is a strap which is long enough to go around the body of a person attached to the outside of the hollow tubular member.

* * * * *